US010519641B2

(12) United States Patent
Wang et al.

(10) Patent No.: US 10,519,641 B2
(45) Date of Patent: Dec. 31, 2019

(54) LIGHT-EMITTING ROTARY KNOB AND FLUSHING TOILET COVER

(71) Applicant: WDI (Changtai) Technology Co., Ltd., Fujian (CN)

(72) Inventors: Jinjiang Wang, Fujian (CN); Huiqing Wang, Fujian (CN)

(73) Assignee: Changtai Yike Technology Co., Ltd., Zhangzhou, Fujian (CN)

( * ) Notice: Subject to any disclaimer, the term of this patent is extended or adjusted under 35 U.S.C. 154(b) by 119 days.

(21) Appl. No.: 15/575,948

(22) PCT Filed: Sep. 1, 2017

(86) PCT No.: PCT/CN2017/100126
§ 371 (c)(1),
(2) Date: Nov. 21, 2017

(87) PCT Pub. No.: WO2018/214329
PCT Pub. Date: Nov. 29, 2018

(65) Prior Publication Data

US 2018/0355597 A1 Dec. 13, 2018

(30) Foreign Application Priority Data

May 26, 2017 (CN) ..... 2017 2 0599676 U

(51) Int. Cl.
*E03D 5/04* (2006.01)
*E03D 1/30* (2006.01)

(52) U.S. Cl.
CPC ..... *E03D 5/04* (2013.01); *E03D 1/306* (2013.01)

(58) Field of Classification Search
CPC ..... E03D 5/04; E03D 1/306; E03D 5/028; E03D 5/09
USPC ..... 4/242.1
See application file for complete search history.

(56) References Cited

U.S. PATENT DOCUMENTS

2018/0259188 A1* 9/2018 Bach ..... F24C 7/082

FOREIGN PATENT DOCUMENTS

WO WO-2017020963 A1 * 2/2017 ..... H01H 9/161

* cited by examiner

*Primary Examiner* — Christine J Skubinna
(74) *Attorney, Agent, or Firm* — Muncy, Geissler, Olds & Lowe, P.C.

(57) ABSTRACT

The utility model discloses a light-emitting rotary knob. The light-emitting rotary knob comprises a rotary knob body, a connecting base and a PCB, wherein a plurality of LED light-emitting bodies are mounted on the PCB, a connecting concave hole is formed in one end of the connecting base, the rotary knob body is provided with a concave cavity and connected with the connecting base in a sleeving mode through the other end of the connecting base by means of the concave cavity, the PCB is mounted on the connecting base, and the multiple LED light-emitting bodies guide out light through the rotary knob body. Preferably, the connecting base comprises a cylindrical body, a protruding part extends out from the middle of one end of the cylindrical body, the connecting concave hole extends into the cylindrical body from the end face of the protruding part, a through hole is formed in the middle of the PCB, the protruding part is sleeved with the PCB through the middle through hole, the multiple LED light-emitting bodies are distributed around the through hole, and the cylindrical body is located in the concave cavity. The light-emitting rotary knob of the utility model has a good prompt effect, correct operation can be ensured, and the grade of a flushing toilet cover can be improved easily.

8 Claims, 6 Drawing Sheets

LIGHT-EMITTING ROTARY KNOB AND FLUSHING TOILET COVER

BACKGROUND OF THE UTILITY MODEL

Technical Field

The utility model relates to the technical field of manufacturing flushing toilet covers, in particular to a light-emitting rotary knob and a flushing toilet cover provided with the light-emitting rotary knob.

Description of Related Art

An existing mechanical-control flushing toilet cover generally needs to comprise a flushing component, a seating ring and a cover plate, wherein the flushing component is mounted on a ceramic toilet, the seating ring and the cover plate are hinged to the flushing component, and a rotary knob is mounted on the flushing component to control starting and stopping of flushing work; however, the existing rotary knob is only an ordinary rotary knob, is generally mounted in a hidden position and cannot be found by people who do not use flushing toilet covers frequently, and consequentially flushing work cannot be started; or the existing rotary knob is located in a dark place, a user cannot clearly see the direction indication for rotation of the rotary knob, and consequentially misoperation is caused.

BRIEF SUMMARY OF THE UTILITY MODEL

For solving the technical problems, the utility model provides a light-emitting rotary knob which has a good prompt effect and can ensure correct operation and improve the grade of a flushing toilet cover easily.

According to the technical scheme adopted by the utility model for realizing the above purpose, a light-emitting rotary knob comprises a rotary knob body, a connecting base and a PCB, wherein a plurality of LED light-emitting bodies are mounted on the PCB, a connecting concave hole is formed in one end of the connecting base, the rotary knob body is provided with a concave cavity and connected with the connecting base in a sleeving mode through the other end of the connecting base by means of the concave cavity, the PCB is mounted on the connecting base, and the multiple LED light-emitting bodies guide out light through the rotary knob body.

According to the optimization, the connecting base comprises a cylindrical body, a protruding part extends out from the middle of one end of the cylindrical body, the connecting concave hole extends into the cylindrical body from the end face of the protruding part, a through hole is formed in the middle of the PCB, the protruding part is sleeved with the PCB through the middle through hole, the multiple LED light-emitting bodies are distributed around the through hole, and the cylindrical body is located in the concave cavity.

According to the further improvement, at least one positioning protrusion is arranged on the outer circumferential surface of the protruding part, at least one positioning groove is formed in the inner circumferential surface of the through hole in the middle of the PCB, and the positioning groove is matched with the positioning protrusion, so that it is ensured that the PCB is positioned correctly and is prevented from rotating.

According to further optimization, the multiple LED light-emitting bodies are distributed on the side, away from the rotary knob body, of the PCB, and the PCB is embedded into the concave cavity so that a circle of light ring can be guided out from the side face of the rotary knob body.

According to further improvement, two clamping protrusions are arranged on the two sides of the end, close to the protruding part, of the cylindrical body, two clamping hooks are arranged on the two sides of the end, close to the protruding part, of the rotary knob body, and the two clamping hooks are matched with the two clamping protrusion respectively.

According to another further optimization, the multiple LED light-emitting bodies are distributed on the side, close to the rotary knob body, of the PCB, and the multiple LED light-emitting bodies protrude out of the cylindrical body so that a circle of light ring can be guided out from the bottom surface of the rotary knob body.

According to the further improvement, the PCB is covered with a layer of transparent waterproof glue, and the connecting base, the PCB and the rotary knob body are fixedly connected together through the transparent waterproof glue.

According to further improvement, a shifting protrusion and a limiting shoulder are arranged on the outer side face of the rotary knob body.

The utility model further provides a flushing toilet cover provided with the light-emitting rotary knob. Specifically, the flushing toilet cover comprises a flushing component, and the light-emitting rotary knob is mounted on the flushing component.

Furthermore, the flushing component is provided with a switch valve, the switch valve is provided an operation rotary shaft, and the operation rotary shaft is connected into the connecting concave hole in the connecting base of the light-emitting rotary knob in an inserted mode and fixedly connected with the connecting concave hole.

According to the utility model, since the multiple LED light-emitting bodies guide out light through the rotary knob body, when the light-emitting rotary knob of the utility model is mounted on the flushing toilet cover, the attention of people can be drawn easily, a good prompt effect is achieved, and the situation that flushing operation cannot be started due to the fact that a user cannot find the operation rotary knob is prevented. On the other hand, light guided out from the rotary knob body can illuminate a rotation sign arranged on the rotary knob or arranged beside the rotary knob so that the user can recognize the operation direction even in a dark place, correct operation can be ensured, and misoperation is prevented. In addition, when the light-emitting rotary knob of the utility model is mounted on the flushing toilet cover, the grade of the flushing toilet cover can be improved easily.

DETAILED DESCRIPTION OF THE UTILITY MODEL

A further detailed description of the utility model is given with accompanying drawings and specific embodiments as follows.

Figure 1:
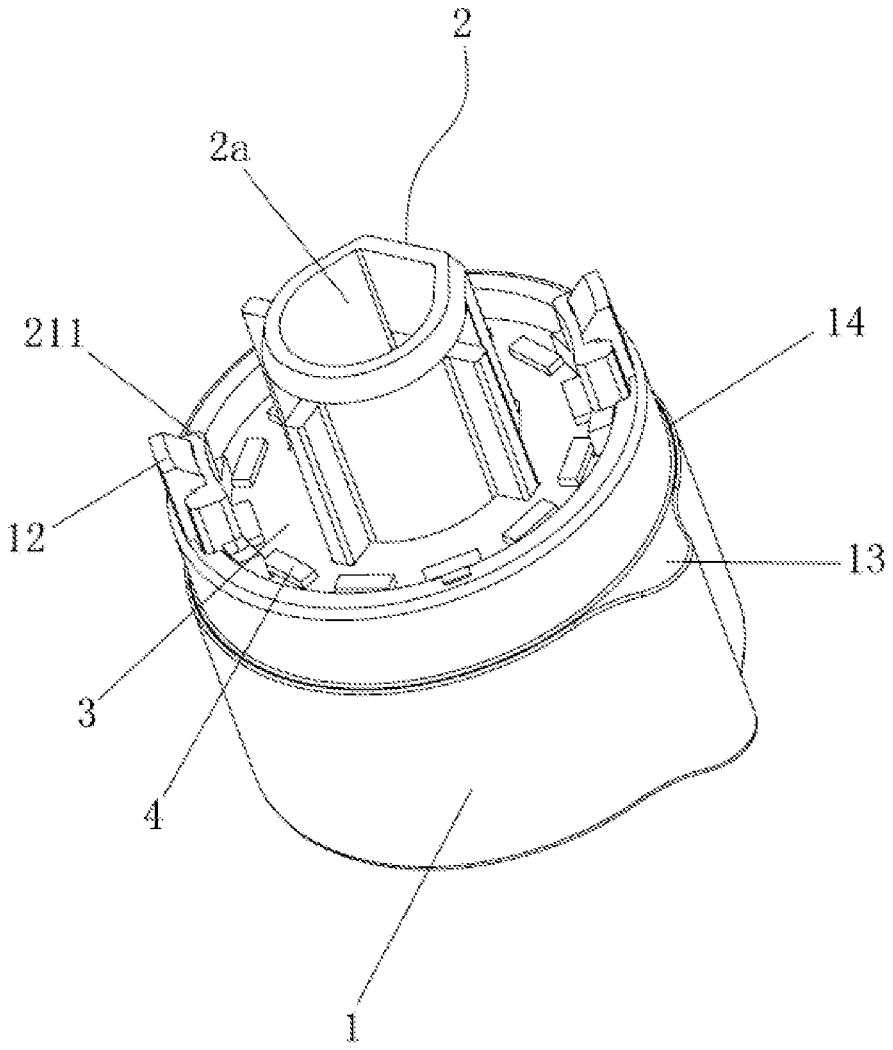
FIG. 1 is a solid diagram of a first embodiment of the utility model.
Figure 2:
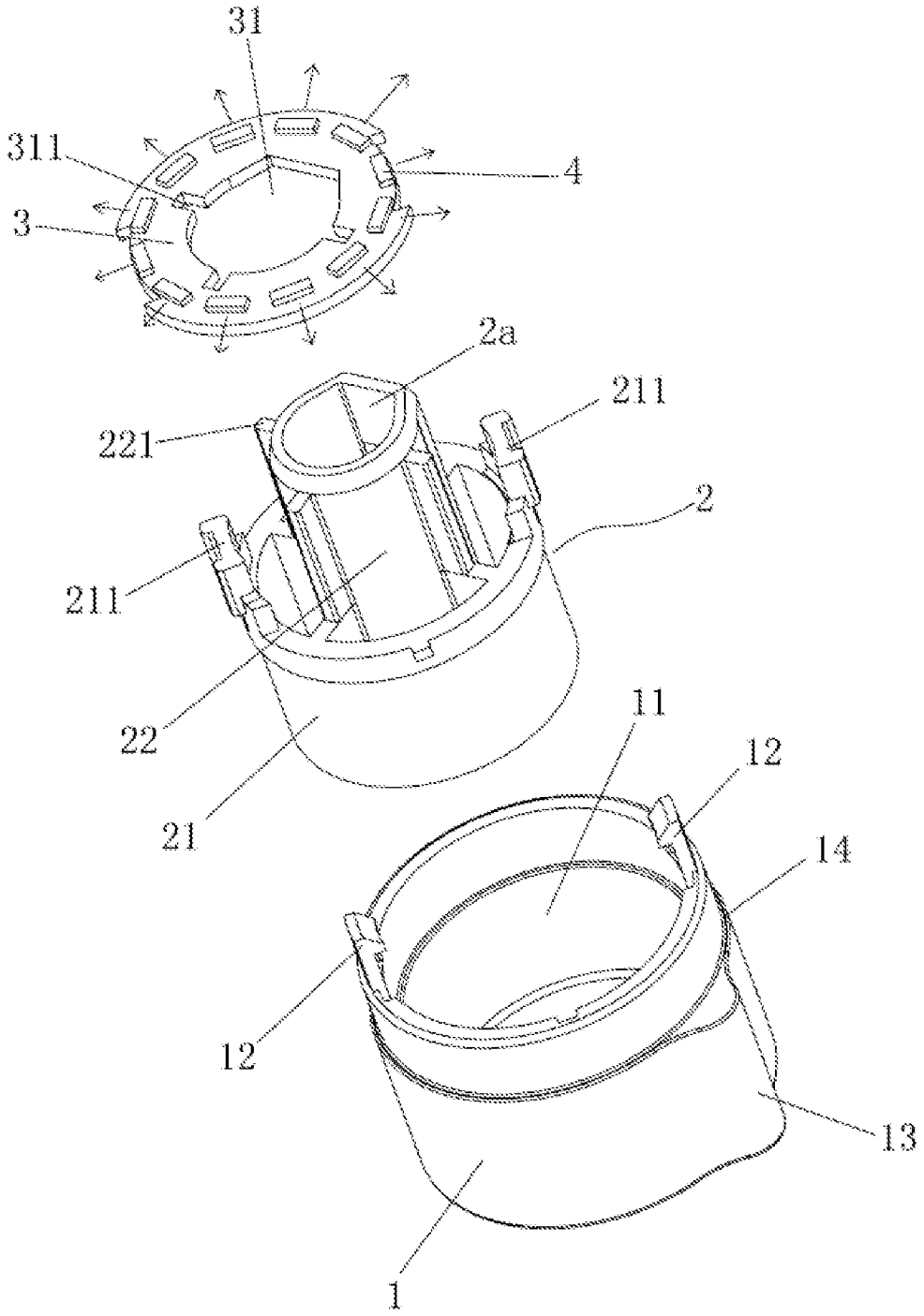
FIG. 2 is a solid exploded view of the first embodiment of the utility model.
Figure 3:
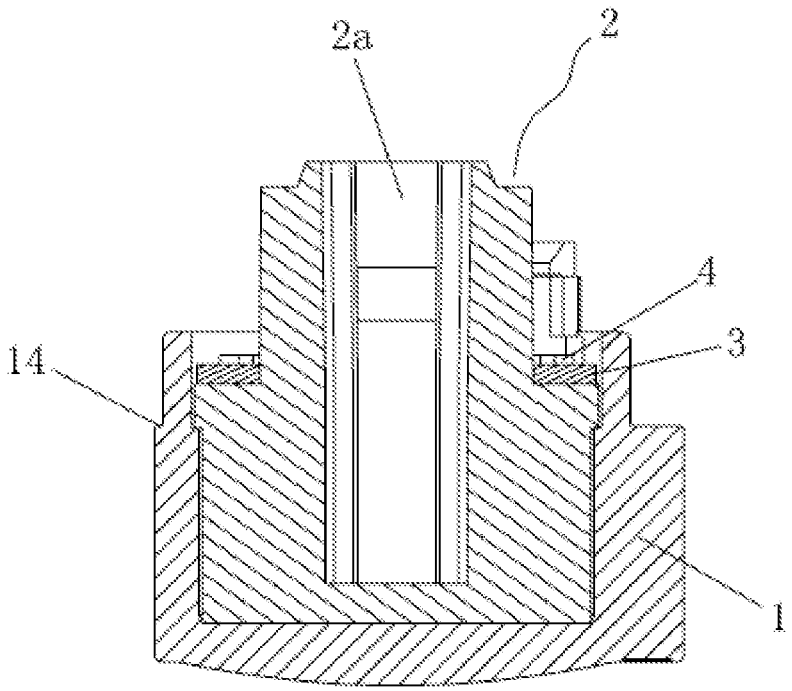
FIG. 3 is a sectional structure diagram of the first embodiment of the utility model.

FIGS. 1-3 show a first embodiment of a light-emitting rotary knob of the utility model, the light-emitting rotary knob comprises a rotary knob body 1, a connecting base 2 and a PCB 3, wherein the rotary knob body 1 is made of a transparent material and is transparent; a plurality of LED light-emitting bodies 4 are mounted on the PCB 3, a connecting concave hole 2*a* is formed in one end of the connecting base 2, the rotary knob body 1 is provided with a concave cavity 11 and connected with the connecting base 2 in a sleeving mode through the other end of the connecting base 2 by means of the concave cavity 11, the PCB 3 is mounted on the connecting base 2 and is located in the concave cavity 11, and the multiple LED light-emitting bodies 4 guide out light through the rotary knob body 1.

The connecting base 2 comprises a cylindrical body 21, the cylindrical body 21 is a cylinder, a protruding part 22 extends out from the middle of one end of the cylindrical body 21, the connecting concave hole 2*a* extends into the cylindrical body 21 from the end face of the protruding part 22, a through hole 31 is formed in the middle of the PCB 3, the protruding part 22 is sleeved with the PCB 3 through the middle through hole 31, the multiple LED light-emitting bodies 4 are distributed around the through hole 31 and distributed on the side, away from the rotary knob body 1, of the PCB 3, and the cylindrical body 21 is located in the concave cavity 11.

Three positioning protrusions 221 are arranged on the outer circumferential surface of the protruding part 22, three positioning grooves 311 are font led in the inner circumferential surface of the through hole 31 in the middle of the PCB 3, and each positioning groove 311 is matched with one positioning protrusion 211.

Two clamping protrusions 211 are arranged on the two sides of the end, close to the protruding part 22, of the cylindrical body 21, two clamping hooks 12 are arranged on the two sides of the end, close to the protruding part 22, of the rotary knob body 1, and the two clamping hooks 12 are matched with the two clamping protrusion 211 respectively A shifting protrusion 13 and a limiting shoulder 14 are arranged on the outer side face of the rotary knob body 1. The rotary knob body 1 can be rotated conveniently through the shifting protrusion 13, and the limiting shoulder 14 can be used for limiting in the mounting process.

The PCB 3 can be further covered with a layer of transparent waterproof glue, and the connecting base 2, the PCB and the rotary knob body 1 are fixedly connected together through the transparent waterproof glue.

Furthermore, as is shown in FIG. 2, the multiple LED light-emitting bodies 4 of the embodiment guide out light through the side face of the rotary knob body 1, a circle of light ring can be clearly seen from the outer side face of the rotary knob body 1, and of course, since the whole rotary knob body 1 is transparent, the whole rotary knob body 1 can present a light-emitting effect.

Figure 4:
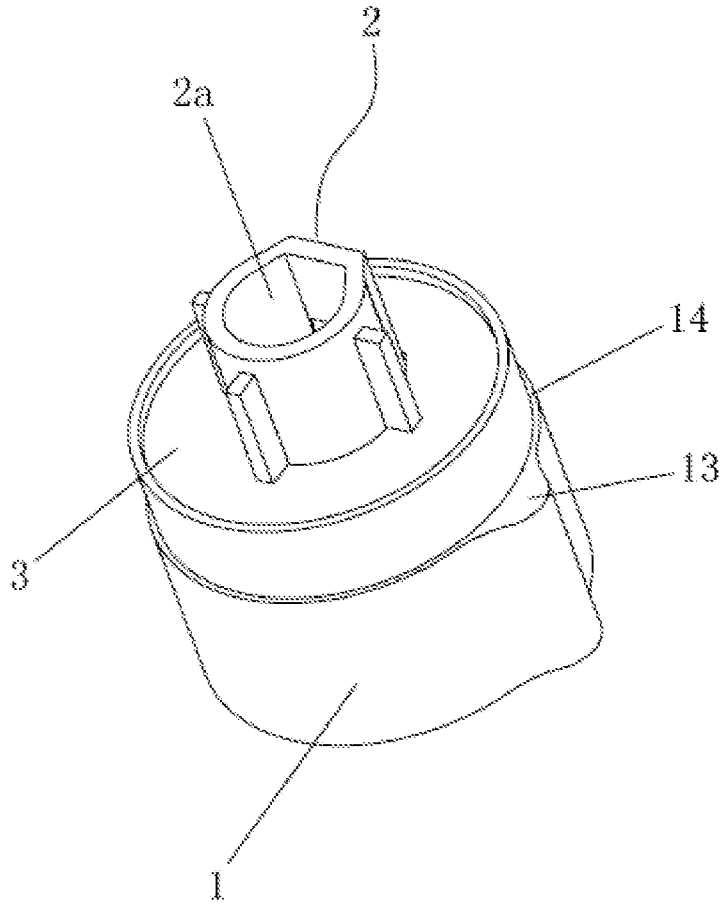
FIG. 4 is a solid diagram of a second embodiment of the utility model.
Figure 5:
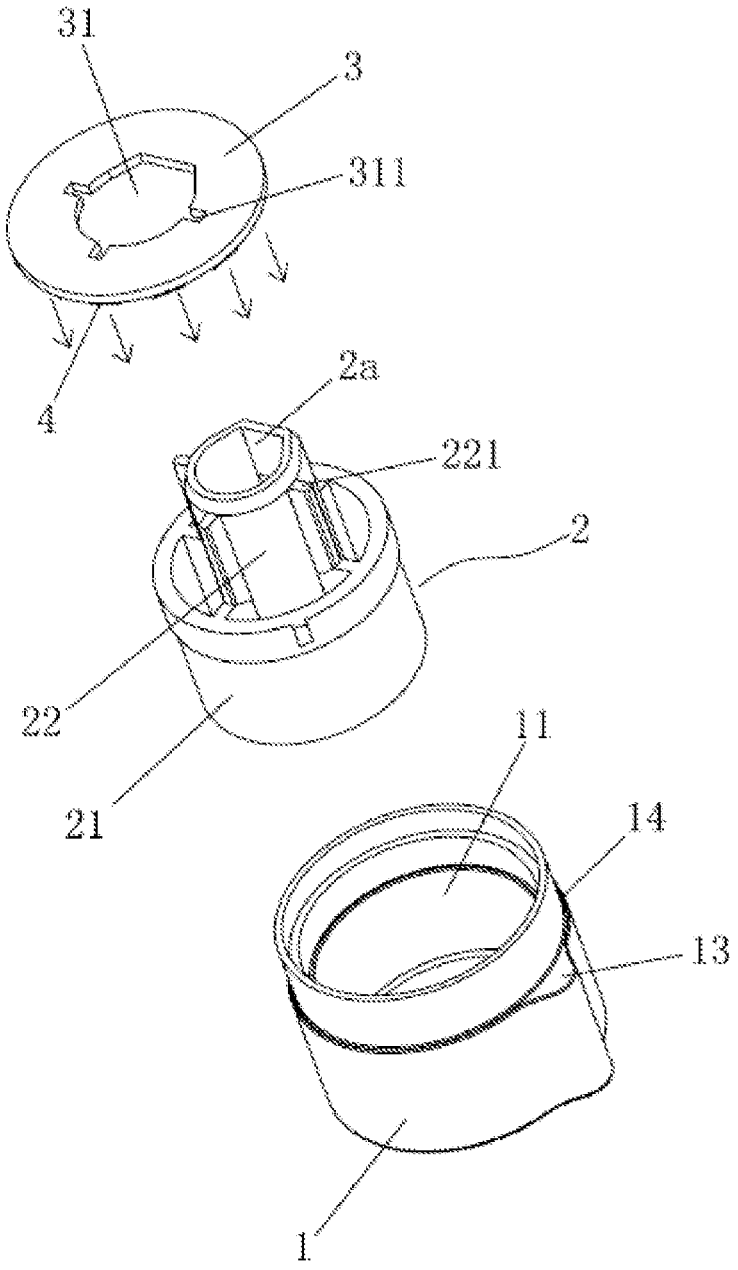
FIG. 5 is a solid exploded view of the second embodiment of the utility model.
Figure 6:
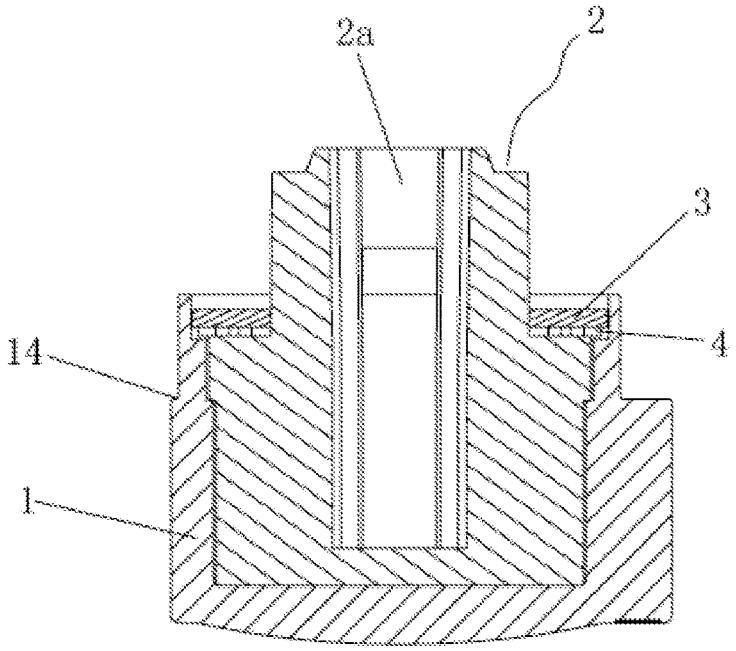
FIG. 6 is a sectional structure diagram of the second embodiment of the utility model.

FIGS. 4-6 show a second embodiment of a novel light-emitting rotary knob of the utility model, the light-emitting rotary knob comprises a rotary knob body 1, a connecting base 2 and a PCB 3, wherein the rotary knob body 1 is made of a transparent material and is transparent; a plurality of LED light-emitting bodies 4 are mounted on the PCB 3, a connecting concave hole 2*a* is formed in one end of the connecting base 2, the rotary knob body 1 is provided with a concave cavity 11 and connected with the connecting base 2 in a sleeving mode through the other end of the connecting base 2 by means of the concave cavity 11, the PCB 3 is located in the concave cavity 11 and can also lean against the end face of the rotary knob body 1, and the multiple LED light-emitting bodies 4 guide out light through the rotary knob body 1.

The connecting base 2 comprises a cylindrical body 21, the cylindrical body 21 is a cylinder, a protruding part 22 extends out from the middle of one end of the cylindrical body 21, the connecting concave hole 2*a* extends into the cylindrical body 21 from the end face of the protruding part 22, a through hole 31 is formed in the middle of the PCB 3, the protruding part 22 is sleeved with the PCB 3 through the middle through hole 31, the multiple LED light-emitting bodies 4 are distributed around the through hole 31 and distributed on the side, close to the rotary knob body 1, of the PCB 3, meanwhile, the multiple LED light-emitting bodies 4 protrude out of the cylindrical body 21, and the cylindrical body 21 is located in the concave cavity 11.

Three positioning protrusions 221 are arranged on the outer circumferential surface of the protruding part 22, three positioning grooves 311 are formed in the inner circumferential surface of the through hole 31 in the middle of the PCB 3, and each positioning groove 311 is matched with one positioning protrusion 211.

A shifting protrusion 13 and a limiting shoulder 14 are arranged on the outer side face of the rotary knob body 1. The rotary knob body 1 can be rotated conveniently through the shifting protrusion 13, and the limiting shoulder 14 can be used for limiting in the mounting process.

The PCB 3 can be further covered with a layer of transparent waterproof glue, and the connecting base 2, the PCB and the rotary knob body 1 are fixedly connected together through the transparent waterproof glue.

Furthermore, as is shown in FIG. 5, the multiple LED light-emitting bodies 4 of the embodiment guide out light through the side face of the rotary knob body 1, a circle of light ring can be clearly seen from the bottom surface of the rotary knob body 1, and of course, since the whole rotary knob body 1 is transparent, the whole rotary knob body 1 can present a light-emitting effect.

Figure 7:
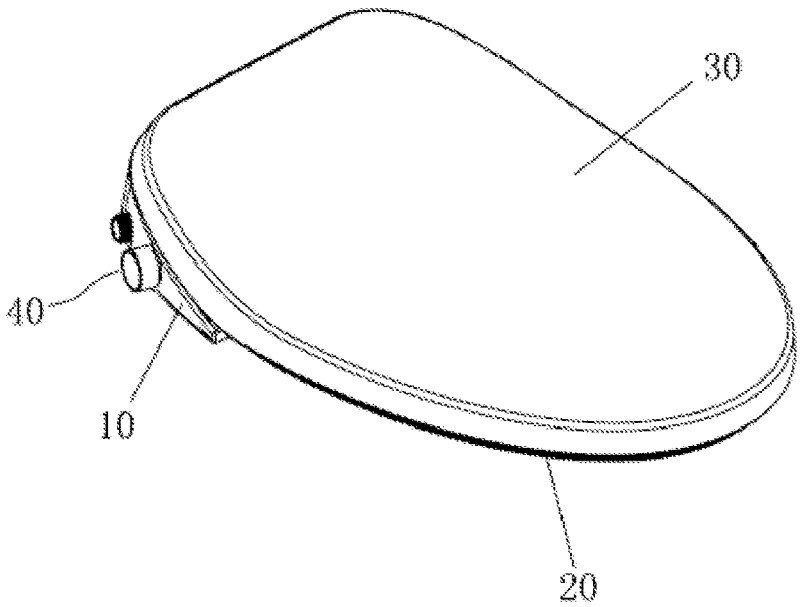
FIG. 7 is a solid diagram of a flushing toilet cover of the utility model.

FIG. 7 shows an embodiment of a flushing toilet cover of the utility model, the flushing toilet cover comprises a flushing component 10, a seating ring 20 and a cover plate 30, wherein the seating ring 20 and the cover plate 30 are hinged to the flushing component 10, and the light-emitting rotary knob 40 in the first embodiment or the second embodiment is mounted on the flushing component 10.

The flushing component 10 is provided with a switch valve, the switch valve is provided with an operation rotary shaft, and the operation rotary shaft is connected into the connecting concave hole in the connecting base of the light-emitting rotary knob 40 in an inserted mode and fixedly connected with the connecting concave hole.

The foregoing description is only several preferred embodiments of the utility model, and equivalent changes made by those skilled in the field according to the claims are all within the protection scope of the scheme.

What is claimed is:

1. A light-emitting rotary knob, comprising a rotary knob body, wherein further comprising a connecting base and a PCB, wherein a plurality of LED light-emitting bodies are mounted on the PCB, a connecting concave hole is formed in one end of the connecting base, the rotary knob body is provided with a concave cavity and connected with the connecting base in a sleeving mode through the other end of the connecting base by means of the concave cavity, the PCB is mounted on the connecting base, and the multiple LED light-emitting bodies guide out light through the rotary knob body;

wherein the connecting base comprises a cylindrical body, a protruding part extends out from the middle of one end of the cylindrical body, the connecting concave hole extends into the cylindrical body from the end face of the protruding part, a through hole is formed in the middle of the PCB, the protruding part is sleeved with the PCB through the middle through hole, the multiple LED light-emitting bodies are distributed around the through hole, and the cylindrical body is located in the concave cavity, wherein at least one positioning protrusion is arranged on the outer circumferential surface of the protruding part, at least one positioning groove is formed in the inner circumferential surface of the through hole in the middle of the PCB, and the positioning groove is matched with the positioning protrusion.

2. The light-emitting rotary knob according to claim 1, wherein the multiple LED light-emitting bodies are distributed on the side, away from the rotary knob body, of the PCB, and the PCB is embedded into the concave cavity.

3. The light-emitting rotary knob according to claim 2, wherein two clamping protrusions are arranged on the two sides of the end, close to the protruding part, of the cylindrical body, two clamping hooks are arranged on the two sides of the end, close to the protruding part, of the rotary knob body, and the two clamping hooks are matched with the two clamping protrusion respectively.

4. The light-emitting rotary knob according to claim 1, wherein the multiple LED light-emitting bodies are distributed on the side, close to the rotary knob body, of the PCB, and the multiple LED light-emitting bodies protrude out of the cylindrical body.

5. The light-emitting rotary knob according to claim 1, wherein the PCB is covered with a layer of transparent waterproof glue, and the connecting base, the PCB and the rotary knob body are fixedly connected together through the transparent waterproof glue.

6. The light-emitting rotary knob according to claim 1, wherein a shifting protrusion and a limiting shoulder are arranged on the outer side face of the rotary knob body.

7. A flushing toilet cover, comprising a flushing component, on which the light-emitting rotary knob is mounted, wherein the light-emitting rotary knob, comprising a rotary knob body, further comprising a connecting base and a PCB, wherein a plurality of LED light-emitting bodies are mounted on the PCB, a connecting concave hole is formed in one end of the connecting base, the rotary knob body is provided with a concave cavity and connected with the connecting base in a sleeving mode through the other end of the connecting base by means of the concave cavity, the PCB is mounted on the connecting base, and the multiple LED light-emitting bodies guide out light through the rotary knob body.

8. The flushing toilet cover according to claim 7, wherein the flushing component is provided with a switch valve, the switch valve is provided with an operation rotary shaft, and the operation rotary shaft is connected into the connecting concave hole in the connecting base of the light-emitting rotary knob in an inserted mode and fixedly connected with the connecting concave hole.

* * * * *